US005598985A

United States Patent [19]

Winesett

[11] Patent Number: 5,598,985

[45] Date of Patent: Feb. 4, 1997

[54] CHRISTMAS LIGHT REEL

[76] Inventor: Sandy C. Winesett, 6617 Pleasant Plains Way, Las Vegas, Nev. 89108

[21] Appl. No.: 445,529

[22] Filed: May 23, 1995

[51] Int. Cl.[6] ..... B65H 75/28; B65H 75/38

[52] U.S. Cl. ..... 242/395; 242/404.1; 242/406; 242/407; 242/598.6; 242/586.6; 242/125.1; 242/125.2; 242/583

[58] Field of Search ..... 242/395, 395.1, 242/402, 404.1, 406, 407, 598.3, 598.5, 598.6, 586.6, 586, 611.2, 125.1, 125.2, 129.6, 129.62, 917, 583; 206/419, 511, 509

[56] References Cited

U.S. PATENT DOCUMENTS

| | | | |
|---|---|---|---|
| D. 247,218 | 2/1978 | Barber | D8/359 |
| D. 339,976 | 10/1993 | Ferguson, Sr. | D8/359 |
| 1,569,495 | 1/1926 | Immel | 242/406 |
| 1,813,990 | 7/1931 | De Vry | 242/611.2 |
| 2,890,005 | 6/1959 | Hoogestraat | 242/395 |
| 3,876,045 | 4/1975 | Knarreborg | 242/406 |
| 4,034,932 | 7/1977 | Ferch | 242/917 |
| 4,431,144 | 2/1984 | Foster | 242/406 |
| 4,540,136 | 9/1985 | Rauch | 242/396.9 |
| 4,685,633 | 8/1987 | Pellini | 242/598.5 |
| 4,791,752 | 12/1988 | Van Kampen | 242/402 |
| 4,917,323 | 4/1990 | Wing . | |
| 4,950,518 | 8/1990 | Walliser | 242/583 |
| 5,184,726 | 2/1993 | Box | 206/511 |
| 5,287,965 | 2/1994 | Miller | 206/396 |

*Primary Examiner*—John M. Jillions
*Attorney, Agent, or Firm*—Joseph N. Breaux

[57] ABSTRACT

A Christmas light reel includes a spool housing, a spool disposed within the housing, a crank having a shaft passing through the spool and the housing in a manner such that the spool and the shaft rotate together with respect to the housing. The spool includes a resilient spool cylinder and a pair of cord clips. One cord clip is located at each end of the spool for securing the ends of a string of lights wound upon the spool. The resilient spool is preferably constructed from a plastic foam material and coated with a tacky adhesive.

16 Claims, 5 Drawing Sheets

CHRISTMAS LIGHT REEL

TECHNICAL FIELD

The present invention relates to devices for storing long flexible cords and more particularly to devices for storing long flexible electrical cords having multiple light bulbs attached along the length thereof.

BACKGROUND ART

Strings of Christmas tree and outdoor Christmas lights often become a tangled mess when the Christmas decorations are taken down after the Christmas season has passed. The light strings are generally removed from position and coiled or looped around the hand of the person taking the light string down and then placed in a box. When retrieved for use the next Christmas season the strings of lights are often tangled and generally some of the lights are broken. It would be a benefit, therefore, to have a reel upon which the strings of lights could be wound as they are taken down, stored, and unwound the next Christmas season. It would be a further benefit if the reel was constructed from materials that reduced the number of broken lights, and if multiple reels could be connected together for storage.

GENERAL SUMMARY DISCUSSION OF INVENTION

It is thus an object of the invention to provide a Christmas light reel upon which the strings of lights may be wound as they are taken down, stored, and unwound the next Christmas season.

It is a further object of the invention to provide a Christmas light reel that reduces the number of broken lights by providing resilient padding to surfaces within the reel.

It is a still further object of the invention to provide a Christmas light reel that may be interconnected with identical Christmas lights reels for storage of the reels in an attic or other storage area.

Accordingly, a Christmas light reel is provided that includes a spool housing, a spool disposed within the housing, a crank having a shaft passing through the spool and the housing in a manner such that the spool and the shaft rotate together with respect to the housing. The spool includes a resilient spool cylinder and a pair of cord clips. One cord clip is located at each end of the spool for securing the ends of a string of lights wound upon the spool. The resilient spool is preferably constructed from a plastic foam material and coated with a tacky adhesive.

The housing may additionally include a pair of sling apertures to which a sling may be attached for conveniently carrying the light reel and/or a set of interlocking tabs and orifices that are arranged in a manner to allow multiple light reels to be interlocked together for easy storage and carrying to and from the decorating site. In addition, the housing may include a handle to ease handling of the light reel when strings of lights are wound and unwound from the spool.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
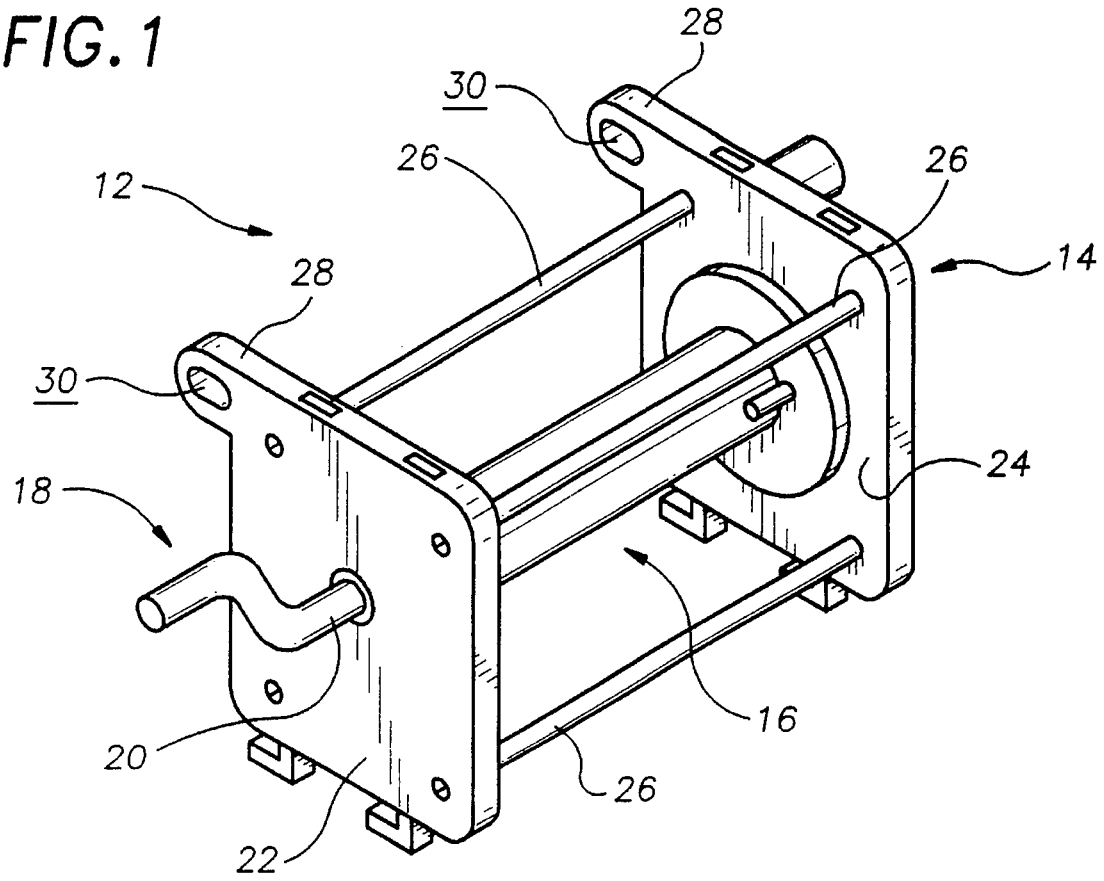
FIG. 1 is a perspective view of an exemplary embodiment of the Christmas light reel of the present invention.

FIG. 1 is a perspective view of an exemplary embodiment of the Christmas light reel of the present invention, generally referenced by the numeral 12. Light reel 12 includes a spool housing, generally referenced by the numeral 14; a spool disposed within spool housing 14, generally referenced by the numeral 16; and a crank, generally referenced by the numeral 18, having a shaft 20 passing through spool 16 and spool housing 14 in a manner such that spool 16 and shaft 20 rotate together with respect to spool housing 14.

Figure 2:
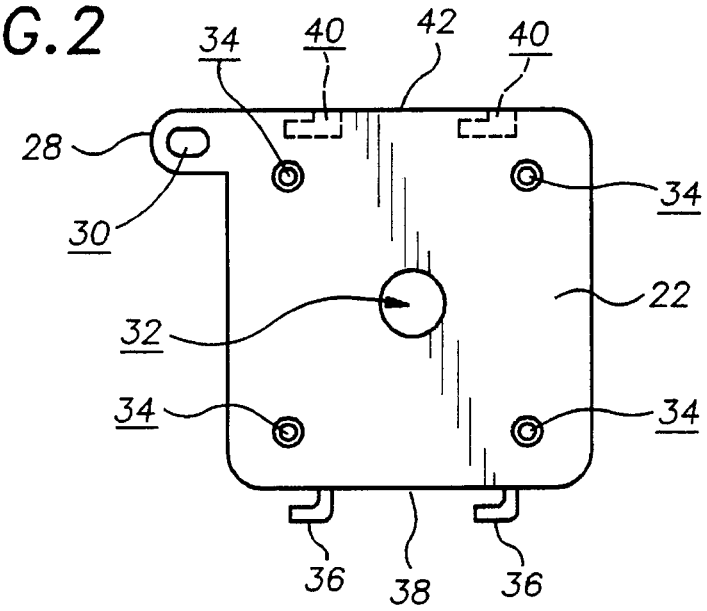
FIG. 2 is a side view of the crank side-member of the Christmas light reel of FIG. 1.
Figure 3:
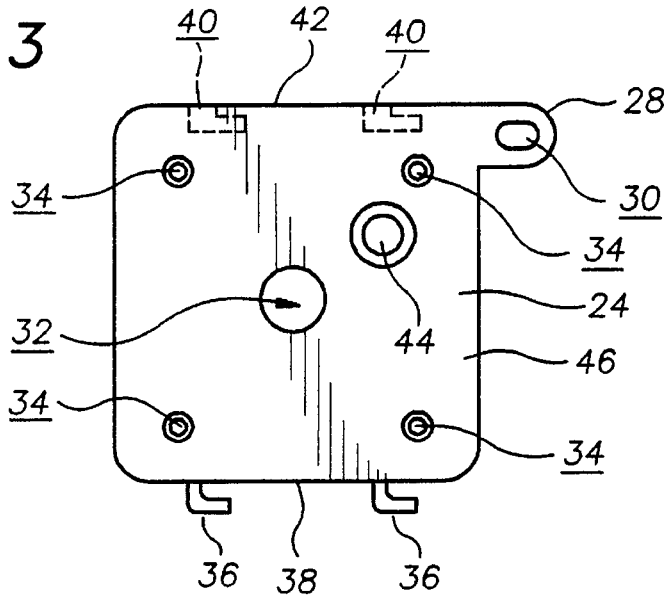
FIG. 3 is a side view of the handle side-member of the Christmas light reel of FIG. 1.
Figure 4:
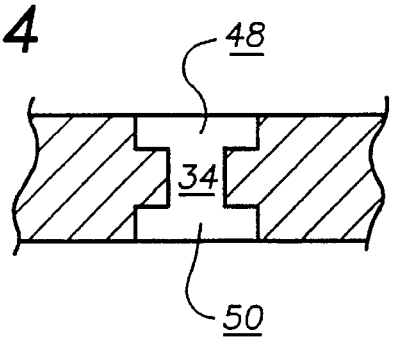
FIG. 4 is a cross-sectional detail view of one of the spacer connecting apertures.
Figure 5:
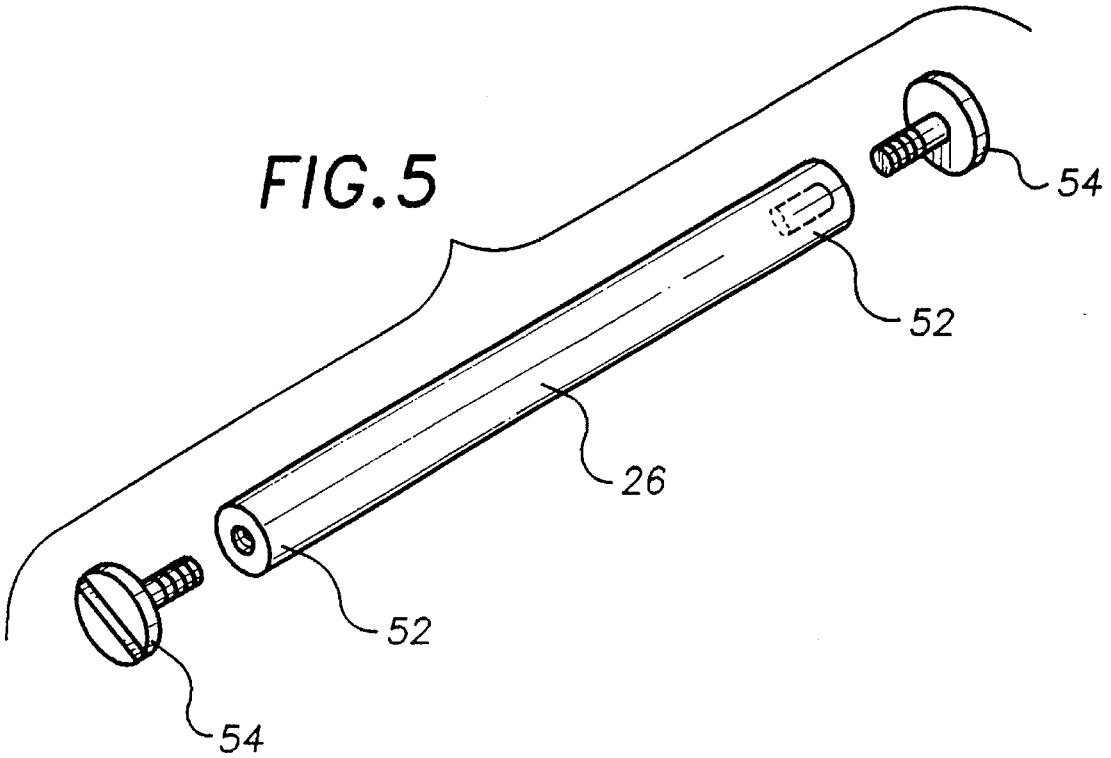
FIG. 5 is an exploded view of one of the four spacers.

Spool housing 14 includes two plastic side-members, crank side-member 22 and handle side-member 24, that are connected together by four, identical, elongated spacer rods 26 (one not shown). As shown in FIGS. 2 and 3, each side-member 22,24 includes a protrusion 28 having a sling aperture 30 formed therethrough; a centrally located shaft aperture 32; four spacer rod connecting apertures 34; two L-shaped interlock tabs 36 positioned on one side edge 38; and two interlock orifices 40 formed into an opposite side edge 42. In addition, handle side-member 24 includes a four-inch long, foam covered, plastic handle 44 protruding from and integrally formed with an out-facing side surface 46. FIG. 4 is a cross-sectional detail view of one of spacer connecting apertures 34. As shown, each spacer connecting aperture 34 includes a screw receiving indent 48 and a spacer rod receiving indent 50 within which the spacer rod ends 52 and spacer mod screws 54 (shown in FIG. 5) are disposed when spool housing 14 is assembled.

Figure 6:
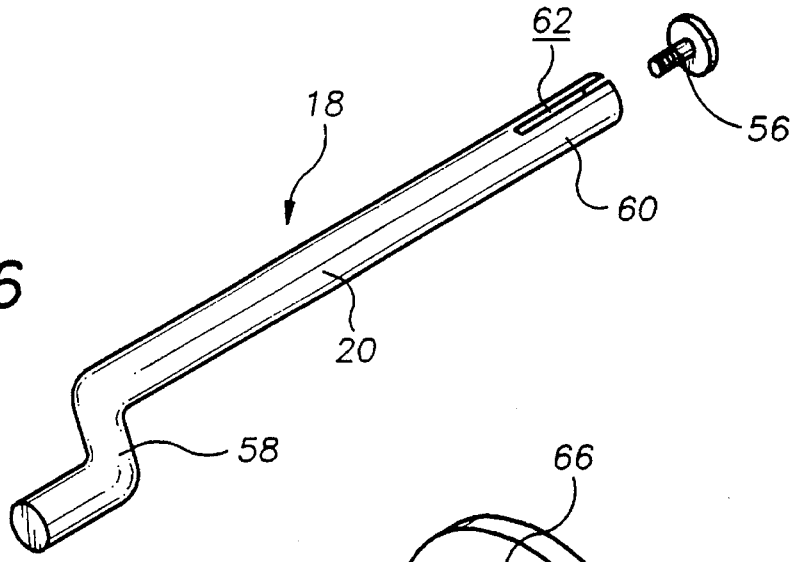
FIG. 6 is a perspective view of the crank.

FIG. 6 is an exploded, perspective view of crank 18 in isolation with a crank connecting screw 56. Crank 18 includes a crank handle 58 in addition to shaft 20. An end 60 of shaft 20 opposite crank handle 58 includes a key way 62 that extends from end 60 about two (2") inches. The head 64 of crank connecting screw 56 has a diameter greater than the diameter of shaft aperture 32.

Figure 8:
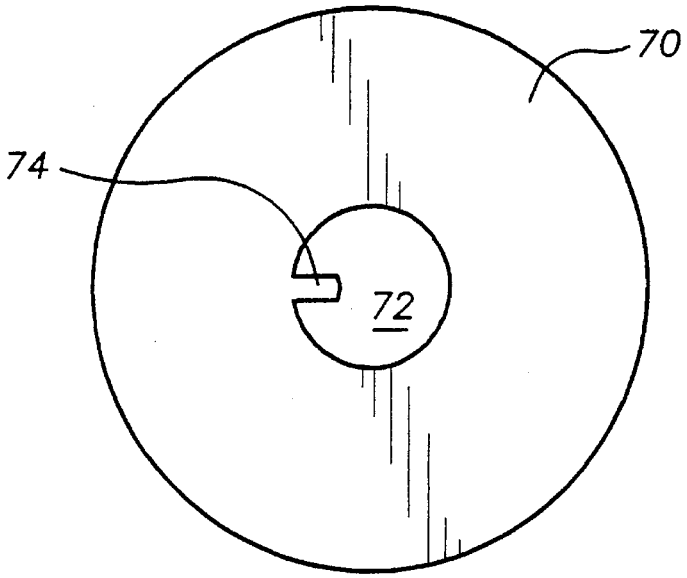
FIG. 8 is a side view of the second spool side illustrating the key member protruding from the wall of the spool aperture.
Figure 9:
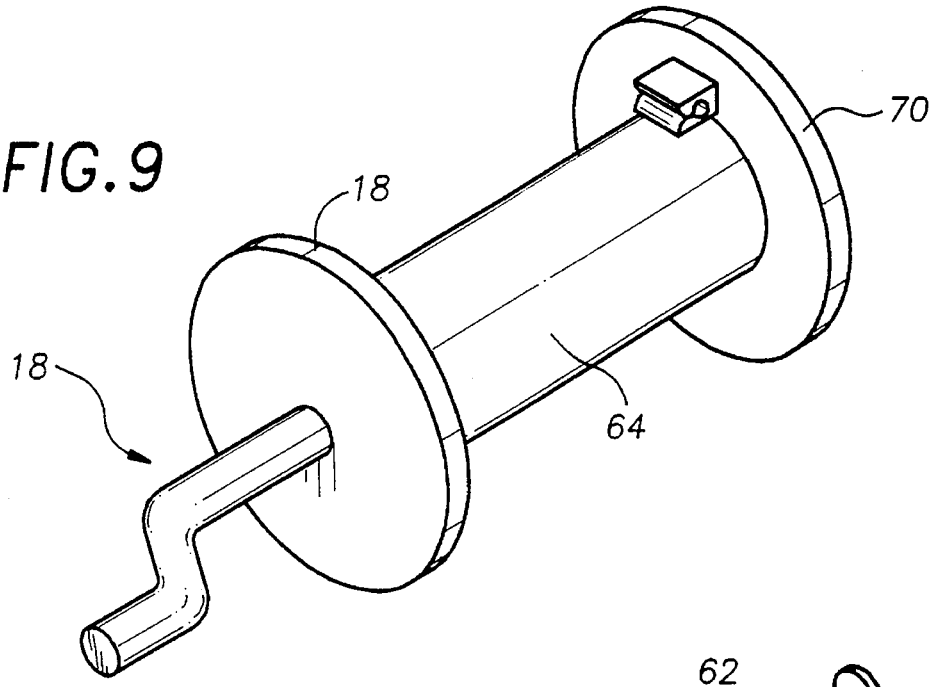
FIG. 9 is a perspective view of the spool with the shaft of the crank inserted through the spool aperture.
Figure 7:
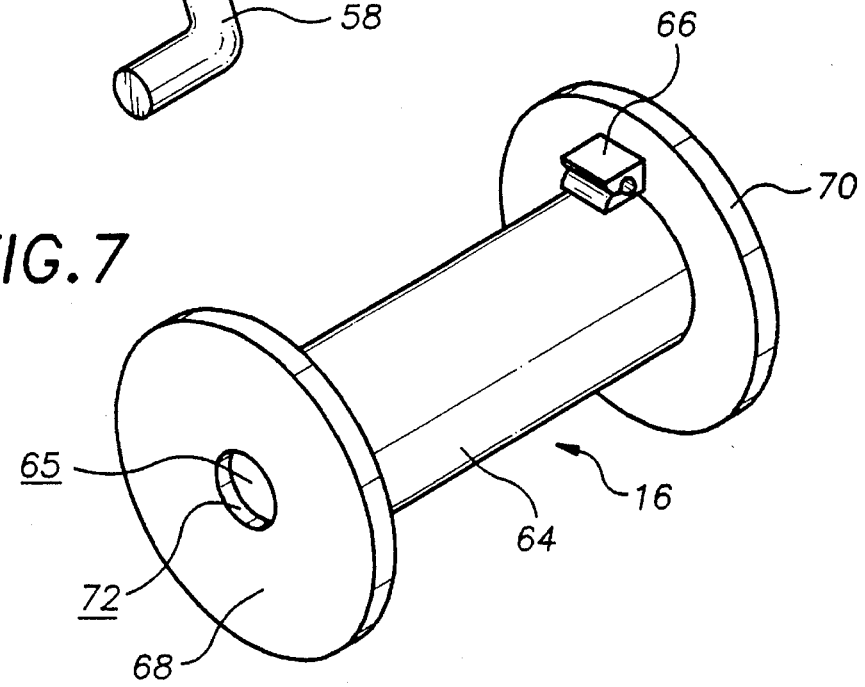
FIG. 7 is a perspective view of the spool.

FIG. 7 is a perspective view of spool 16. Spool 16 includes a fifteen (15") inch long, resilient spool cylinder 64 having a diameter of about two (2") inches that has been coated with a tacky adhesive wax and a central pathway 65 formed longitudinally therethrough that is sized to receive shaft 20 of crank 18; a pair of cord clips 66 (only one shown in FIG. 7), one located at each end of spool cylinder 64; and first and second spool side guards 68,70, one secured to each side of spool cylinder 64. Both spool side guards 68,70 have a diameter of about six (6") inches and include a centrally located aperture 72 (only one shown in FIG. 7) sized to receive shaft 20 of crank 18. Apertures 72 and central pathway 65 are concentrically aligned. FIG. 8 is an end view of spool side guard 70. Spool side guard 70 includes a key member 74 that extends into aperture 72. When shaft 20 is inserted through aperture 72 key member 74 is aligned with and travels within key way 62. Having key member 74 disposed within key way 62 allows shaft 20 to impart rotation force to spool 16. FIG. 9 shows crank 18 inserted through spool side guards 68,70 and spool cylinder 64.

Figure 10:
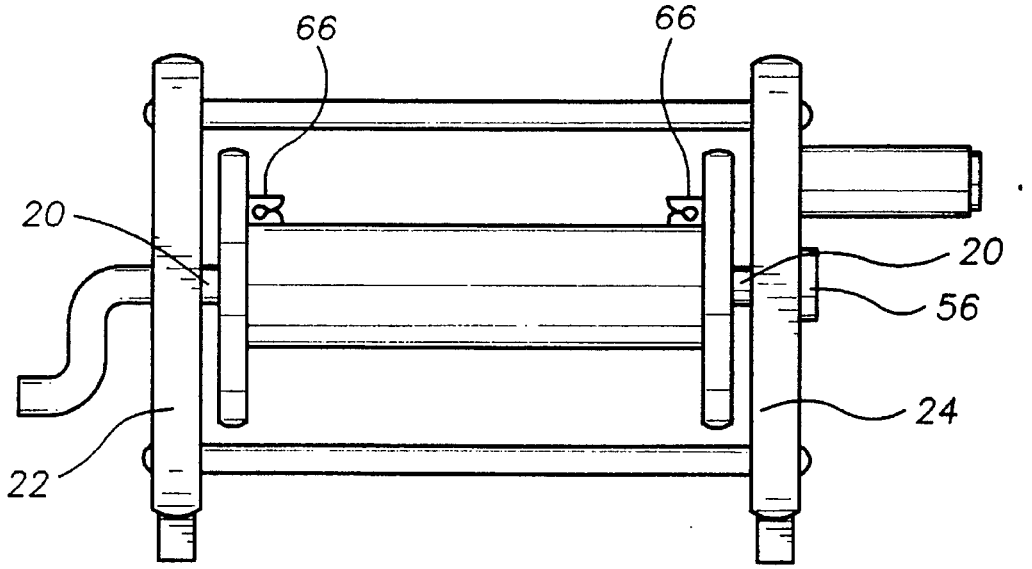
FIG. 10 is a side view of the embodiment of the Christmas light reel of FIG. 1.
Figure 11:
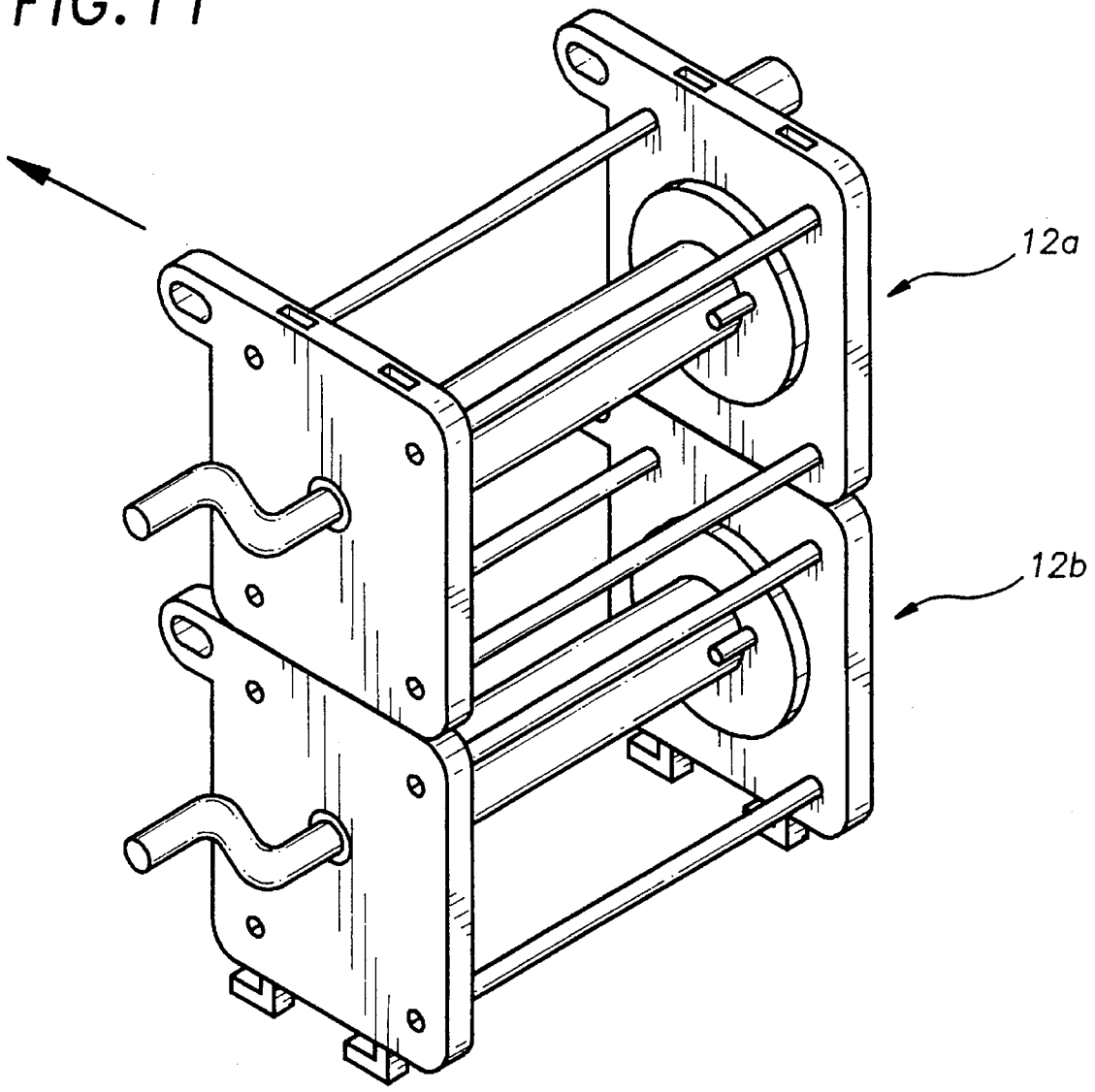
FIG. 11 is a perspective view showing two Christmas light reels interlocked in a storage configuration.

FIG. 10 is a side view of light reel 12 showing shaft 20 installed through Crank side-member 22 and handle side-member 24 with crank screw 56 in place. Also shown are the two cord clips 66. FIG. 11 shows two light reels 12*a*,12*b* that have been interconnected by inserting the L-shaped interlock tabs 36 of light reel 12*a* into the interlock orifices 40 of light reel 12*b* and then laterally sliding light reel 12*a* in the direction indicated by the arrow.

Use of the exemplary embodiment of light reel 12 is now described with general reference to FIGS. 1–11. One plug end of a light string is inserted Laterally into one of the cord clips 66 and crank handle 58 rotated, while grasping handle 44, until the second plug end of the light string is reached. The second plug end is then inserted into the remaining cord clip 66. Of course, multiple strings of lights that are plugged to each other may be wound upon spool 14 in the same manner. As described previously multiple light reels 12 may be connected together for easy transportation and storage. The resilient, adhesive covered spool cylinder 64 provides a cushioned surface against which the bulbs my be supported that tends to adhere to each bulb preventing the bulbs from jostling about and breaking when wound onto spool 16. Removal of the wound light strings is accomplished by reversing the previous steps.

It can be seen from the preceding description that a Christmas light reel upon which the strings of lights may be wound as they are taken down, stored, and unwound the next Christmas season; that reduces the number of broken lights by providing resilient padding to surfaces within the reel; and that may be interconnected with identical Christmas lights reels for storage of the reels in an attic or other storage area has been provided.

It is noted that the embodiment of the Christmas light reel described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A Christmas light reel comprising:

a spool housing, a spool disposed within said spool housing; and a crank having a shaft passing through said spool and said spool housing in a manner such that said spool and said shaft rotate together with respect to said spool housing;

said spool including a spool cylinder, constructed from a resilient material, having an exterior surface coated with a tacky adhesive, and a central pathway formed longitudinally therethrough that is sized to receive said shaft of said crank.

2. The Christmas light reel of claim 1, wherein:

said spool further includes first and second spool side guards, said first spool side guard being secured to a first end of said spool cylinder, said second spool side guard being secured to a second end of said spool cylinder; said spool side guards having a diameter greater than the diameter of said spool cylinder and a centrally located aperture sized to receive said shaft of said crank; said centrally located apertures and said central pathway being concentrically aligned.

3. The Christmas light reel of claim 2, wherein:

said crank further includes a crank handle integrally formed at a first shaft end of said shaft;

said shaft includes a key way formed at a second shaft end thereof that extends from said second shaft end toward said first shaft end, and one of said spool side guards includes a key member that extends into said centrally located aperture that is sized to travel within said key way of said shaft.

4. The Christmas light reel of claim 2 further including:

a pair of cord clips, one of said cord clips being located at an end of said spool cylinder, another of said cord clips being located at another end of said spool cylinder.

5. The Christmas light reel of claim 1 wherein:

said spool housing includes two plastic side-members that are connected together by four elongated spacer rods, each side-member including a centrally located shaft aperture, two L-shaped interlock tabs positioned on one side edge of each said side-member; and two interlock orifices formed into an opposite side edge of each said side-member.

6. The Christmas light reel of claim 5 wherein:

each side-member includes a protrusion having a sling aperture formed therethrough.

7. The Christmas light reel of claim 5 wherein:

each side-member includes four spacer rod connecting apertures, said spacer rod connecting apertures including a screw receiving indent and a spacer rod receiving indent.

8. The Christmas light reel of claim 5, wherein:

one of said side-members including a handle protruding from and integrally formed with an out-facing side surface of said side-member.

9. The Christmas light reel of claim 5, wherein:

each side-member includes a protrusion having a sling aperture formed therethrough; and each side-member includes four spacer rod connecting apertures, said spacer rod connecting apertures including a screw receiving indent and a spacer rod receiving indent.

10. The Christmas light reel of claim 9, wherein:

one of said side-members including a handle protruding from and integrally formed with an out-facing side surface of said side-member.

11. The Christmas light reel of claim 5 wherein:

each side-member includes four spacer rod connecting apertures, said spacer rod connecting apertures including a screw receiving indent and a spacer rod receiving indent; and one of said side-members including a handle protruding from and integrally formed with an out-facing side surface of said side-member.

12. The Christmas light reel oil claim 5, wherein:

said spool further includes first and second spool side guards, said first spool side guard being secured to a first end of said spool cylinder, said second spool side guard being secured to a second end of said spool cylinder; said spool side guards having a diameter greater than the diameter of said spool cylinder and a centrally located aperture sized to receive said shaft of said crank; said centrally located apertures and said central pathway being concentrically aligned.

13. The Christmas light reel of claim 12, wherein:

said crank further includes a crank handle integrally formed at a first shaft end of said shaft;

said shaft includes a key way formed at a second shaft end thereof that extends from said second shaft end toward said first shaft end, and one of said spool side guards includes a key member that extends into said centrally located aperture that is sized to travel within said key way of said shaft.

14. The Christmas light reel of claim 12 further including:

a pair of cord clips, one of said cord clips being located at an end of said spool cylinder, another of said cord clips being located at another end of said spool cylinder.

15. The Christmas light reel of claim 14, wherein:

said crank further includes a crank handle integrally formed at a first shaft end of said shaft;

said shaft includes a key way formed at a second shaft end thereof that extends from said second shaft end toward said first shaft end, and one of said spool side guards includes a key member that extends into said centrally located aperture that is sized to travel within said key way of said shaft.

16. The Christmas light reel of claim 1, wherein:

said spool further includes first and second spool side guards, said first spool side guard being secured to a first end of said spool cylinder, said second spool side guard being secured to a second end of said spool cylinder; said spool side guards having a diameter greater than the diameter of said spool cylinder and a centrally located aperture sized to receive said shaft of said crank; said centrally located apertures and said central pathway being concentrically aligned;

said crank further includes a crank handle integrally formed at a first shaft end of said shaft;

said shaft includes a key way formed at a second shaft end thereof that extends from said second shaft end toward said first shaft end;

one of said spool side guards includes a key member that extends into said centrally located aperture that is sized to travel within said key way of said shaft; and said light reel further includes a pair of cord clips, one of said cord clips being located at an end of said spool cylinder, another of said cord clips being located at another end of said spool cylinder.

* * * * *